US005866519A

United States Patent [19]

Watts et al.

[11] Patent Number: 5,866,519

[45] **Date of Patent: *Feb. 2, 1999**

[54] AUTOMATIC TRANSMISSION FLUIDS OF IMPROVED VISCOMETRIC PROPERTIES

[75] Inventors: Raymond Frederick Watts, Long Valley; Ricardo Alfredo Bloch, Scotch Plains, both of N.J.

[73] Assignee: Exxon Chemical Patents Inc., Linden, N.J.

[ * ] Notice: The term of this patent shall not extend beyond the expiration date of Pat. No. 5,646,099.

[21] Appl. No.: 888,845

[22] Filed: Jul. 7, 1997

Related U.S. Application Data

[63] Continuation-in-part of Ser. No. 503,052, Jul. 17, 1995, Pat. No. 5,646,099.

[51] Int. Cl.[6] ..... C10M 171/02; C10M 119/04

[52] U.S. Cl. ..... 508/232; 508/559; 508/293; 508/295; 508/554; 508/467; 508/472; 508/469; 508/192

[58] Field of Search ..... 508/232

[56] References Cited

U.S. PATENT DOCUMENTS

| | | | |
|---|---|---|---|
| 4,031,020 | 6/1977 | Sugiura, et al. | 252/56 R |
| 4,218,330 | 8/1980 | Shubkin | 252/46.6 |
| 4,299,714 | 11/1981 | Sugiura et al. | 252/73 |
| 4,532,062 | 7/1985 | Ryer et al. | 252/78.1 |
| 4,762,628 | 8/1988 | Phillips et al. | 252/51.5 R |
| 4,776,967 | 10/1988 | Ichihashi et al. | 252/32.7 E |
| 4,827,073 | 5/1989 | Wu | 585/530 |
| 4,853,139 | 8/1989 | Ichihashi | 252/32.7 E |
| 4,857,214 | 8/1989 | Papay et al. | 252/32.5 |
| 4,857,220 | 8/1989 | Hashimoto | 252/56 R |
| 5,089,156 | 2/1992 | Crisope et al. | 252/51.5 A |
| 5,360,562 | 11/1994 | Chrisope et al. | 252/46.6 |
| 5,372,735 | 12/1994 | Ohtani et al. | 252/51.5 R |
| 5,387,346 | 2/1995 | Hartley et al. | 252/49.9 |
| 5,578,236 | 11/1996 | Scrinivasan et al. | 508/188 |
| 5,641,733 | 6/1997 | Bloch et al. | 508/232 |
| 5,646,099 | 7/1997 | Watts et al. | 508/232 |

FOREIGN PATENT DOCUMENTS

| | | | |
|---|---|---|---|
| 0240813 A2 | 10/1987 | European Pat. Off. | C10M 111/04 |
| 0240813-A2 | 10/1987 | European Pat. Off. | C10M 111/04 |
| 0454395 A1 | 10/1991 | European Pat. Off. | C10M 161/00 |
| 0454395-A1 | 10/1991 | European Pat. Off. | C10M 161/00 |
| 0436872 B1 | 9/1993 | European Pat. Off. | C10M 169/04 |
| 0436872B1 | 9/1993 | European Pat. Off. | C10M 169/04 |
| 0394422 | 1/1994 | European Pat. Off. . | |
| 394422 | 1/1994 | European Pat. Off. . | |
| 0630960 A1 | 12/1994 | European Pat. Off. | C10M 161/00 |
| 0630960-A1 | 12/1994 | European Pat. Off. | C10M 161/00 |
| 2501224 | 9/1982 | France | C10M 3/12 |
| 1264981 | 2/1972 | United Kingdom | C10M 1/00 |
| 2057494 | 4/1981 | United Kingdom | C10M 1/28 |
| 2024846 | 10/1982 | United Kingdom | C07C 2/08 |
| 2094339 | 1/1985 | United Kingdom | C10M 3/38 |
| 2267098 | 11/1993 | United Kingdom | C10M 169/04 |

OTHER PUBLICATIONS

Beimesch, B. J. et al., "Viscosity and Volatility Characteristics of Some Model SAE 5W–30 Engine Oil Formulations", *Journal of the American Society of Lubrication Engineering,* vol. 42, 1, Jan., 1986, pp. 24–30.

Blackwell, J. V. et al., "Current and Future Polyalphaolefins" *Journal of Synthetic Lubricants 7–1*, pp. 25–45.

Campen, M. et al. "Lubes for the Future", *Hydrocarbon Processing*, Feb. 1982, pp. 75–82.

Lalla, C. J. et al., "Worldwide Perspective on Automatic Transmission Fluid", *National Petroleum Refiners Association*, 1988 NPRA Fuels & Lubricants Conference, Nov. 3–4, 1988.

Chrisope, D. R. et al. "Automatic Transmission Fluids"(Chapter 16), *Synthetic Lubricants and High–Performance Functional Fluids,* pp. 351–364, Copyright 1993 by Marcel Dekker, Inc.

Davis, J. E. "Oxidation Characteristics of Some Engine Oil Formulations Containing Petroleum and Synthetic Basestocks", *Journal of the American Society of Lubrication Engineers,* Mar. 1987, vol. 43, 3, pp. 199–202.

Graham, R. et al. "Automatic Transmission Fluid Developments Toward Rationalization" *CEC International Symposium on Performance Evaluation of Automatic Fuels & Lubricants*, Wolfsburg, W. Germany, Jun. 5–7, 1985, pp. 45–62.

Hamilton, Gordon D. S. et al. "Development of Automatic Transmission Fluids Having Excellent Low Temperature Viscometric and High Temperature Oxidative Properties" *SAE #902145*, Oct. 22–25, 1990, pp. 887–913.

Hartley, Rolfe J. et al. "The Design of Automatic Transmission Fluid to Meet the Requirements of Electronically Controlled Transmissions" *SAE Technical Paper Series #902151*, Oct. 22–25, 1990, pp. 1–9.

Hobson, D. E. "Axle Efficiency—Test Procedures and Results", presented at *SAE's Passenger Car Meeting,* Jun. 1979, pp. 202–209.

Kemp, Steven P. et al "Physical and Chemical Properties of a Typical Automatic Transmission Fluid" *SAE Technical Paper Series #902148,* Oct. 22–25, 1990, pp. 1–11.

Linden, James L. et al "Improving Transaxle Performance at Low Temperature with Reduced–Viscosity Automatic Transmission Fluids", *SAE Paper #870356,* 1987, pp. 7.21–7.30.

Ovlatt, W. R. et al. "Future Automatic Transmission Fluids–Performance Requirements", *Fuels and Lubricants Conference*, SAE Paper # 865167 (1986).

Papay, A. G. et al., "Advanced Fuel Economy Engine Oils", *Synthetic Automotive Engine Oils Progress in Technology Series 22,* SAE (1981) pp. 237–248.

(List continued on next page.)

*Primary Examiner*—Ellen M. McAvoy

[57] ABSTRACT

This invention provides a composition and method for producing partial synthetic automatic transmission fluids having improved shear-stability and low temperature properties without the need to incorporate polymeric viscosity modifiers.

12 Claims, No Drawings

OTHER PUBLICATIONS

Shubkin, R. L. "Polyalphaolefins: Meeting The Challenge For High–Performance Lubrication", *Journal of the Society of Tribologists and Lubrication Engineers*, Mar., 1994, pp. 196–201.

Sprys, Joseph W. et al., "Shear Viscosities of Automatic Transmission Fluids" *SAE Technical Paper Series #941885*, Oct. 17–20, 1994, pp. 1–11.

van der Waal, G. Bert "Properties and Application of Ester Base Fluids and P.A.O.'s", *vol. LIII, No. 8, NLGI Spokesman, Nov. 1989, pp. 359–368.*

Watts, R.F. "Service Fill Automatic Transmission Fluid For the North American Market", *1991 NPRA, National Fuels and Lubricants Meeting*, Houston, Texas, Nov. 708, 1991, pp. 1–8.

Willermet, P. A. et al., "A Laboratory Evaluation of Partial Synthetic Automatic Transmission Fluids", *Journal of Synthetic Lubricants,* 2(1), pp. 23–38 (1985).

"Formulating Broadly Cross–graded Lubricants With a High VI Polyalphaolefin", *Practical Lubrication & Maintenance.*

AUTOMATIC TRANSMISSION FLUIDS OF IMPROVED VISCOMETRIC PROPERTIES

This application is a continuation-in-part of U.S. Ser. No. 08/503,052, filed Jul. 17, 1995, now U.S. Pat. No. 5,646,099.

This invention relates to compositions and methods of improving properties of automatic transmission fluids, particularly to obtaining partial synthetic automatic transmission fluids having superior low temperature viscometric properties and superior high temperature lubricant film strength.

The operation of an automatic transmission is very dependent on the viscometric characteristics of the automatic transmission fluid (ATF) used. The impact of ATF viscosity on low temperature operation of the transmission is well characterized and has been the subject of several studies (see, e.g., SAE Paper 870356 (1987) and SAE Paper 124T (1960)). The result of this work has been the continual lowering of the Brookfield viscosity requirements for ATF's at −40° C. A common method of producing ATF's of lower Brookfield viscosity is to use lower viscosity base oils. However, such lower viscosity base oils form weaker hydrodynamic films than more viscous base oils. The ability to maintain strong hydrodynamic films is determined by measuring the viscosity of the lubricant at 150° C. under high shear rates, e.g., $1\times10^6$ sec.$^{-1}$. Thus, one objective of the ATF formulator is to minimize low temperature viscosity, i.e., the −40° C. Brookfield viscosity, while maximizing high temperature high shear viscosity, i.e., viscosity at 150° C. and a $10^6$ sec.$^{-1}$ shear rate.

Another ATF property desirable to control, and preferably minimize, is the change of fluid viscosity with time, or vehicle mileage. Fluids with less change in viscosity with use are said to be shear stable. Conventional ATF's use polymeric viscosity modifiers, or thickeners, to achieve kinematic viscosities at 100° C. of at least 6.8 mm$^2$/s (cSt). As such they are susceptible to mechanical and oxidative breakdown. To avoid these undesirable results, we have found that automatic transmission fluids possessing outstanding low temperature properties and good high temperature high shear viscosities can be produced with polymers which function more as flow improvers instead of as polymeric thickeners. Thus, these fluids possess excellent shear stability.

SUMMARY OF THE INVENTION

This invention relates to an automatic transmission fluid comprising:

(a) from about 2 to 80 weight percent of a natural lubricating oil having a kinematic viscosity from 1 to 30 mm$^2$/s at 100° C.;

(b) from about 2 to 80 weight percent of a synthetic lubricating oil having a kinematic viscosity from 1 to 100 mm$^2$/s at 100° C.;

(c) from 1 to 30 weight percent of a seal swelling agent;

(d) from 0.05 to 2.0 weight percent of a flow improver; and (e) from 0.01 to 5.0 weight percent of a friction modifier; providing that the resulting fluid has a kinematic viscosity of at least 4.0 mm$^2$/s at 100° C., a −40° C. Brookfield viscosity no greater than about 18,000 centipoise, a high temperature high shear viscosity of at least 1.5 centipoise at a shear rate of $1\times10^6$ sec.$^{-1}$ and a temperature of 150° C., and no greater than a 0.25 centipoise difference between a high temperature low shear viscosity measured at a shear rate of $2\times10^2$ sec.$^{-1}$ and a temperature of 150° C. and said high temperature high shear viscosity.

An advantage of this invention includes ATF's with excellent low temperature viscosities, i.e., −40° C. Brookfield viscosities of no greater than about 18,000 centipoise (cP), and exceptional film strength as measured by high temperature high shear (HTHS) viscosities of at least 1.5 cP at 150° C. and a shear rate of $10^6$ sec.$^{-1}$. A further advantage of this invention is that the fluids produced derive little, if any, of their kinematic viscosity from the use of polymeric thickeners. This advantage allows the difference in the ATF's high temperature (150° C.) low shear ($2\times10^2$ sec.$^{-1}$) and high temperature (150° C.) high shear ($1\times10^6$ sec.$^{-1}$) viscosities to be close to zero, i.e., no greater than 0.25 cP.

DETAILED DESCRIPTION OF THE INVENTION

It has now been found that ATF's possessing high temperature high shear viscosities of at least 1.5 cP and −40° C. Brookfield viscosities no greater than about 18,000 cP, preferably no greater than about 15,000 cP, and most preferably no greater than about 10,000 cP can be produced by careful selection of base fluids and minimization of polymeric thickeners. These improved ATF's are blends of natural lubricating oils and synthetic lubricating oils, such as poly-alpha-olefins, or alkyl aromatics. The fluids derive little or no viscosity from polymeric additives such as viscosity modifiers. High molecular weight polymers are undesirable since they tend to thicken the fluids initially, but this viscosity increase is lost during use. High molecular weight polymers also contribute to high temperature viscosity only under low shear conditions. When subjected to high shear rates, such as those present in gears and bearings, this viscometric contribution is lost (temporary shear). However, it may be necessary to use small amounts of oil-soluble polymers to gain other benefits such as dispersancy or low temperature flow improvement. When used, the treat rate of these polymers in the fluid would normally be 2 weight percent or less, and preferably these polymers would have a low molecular weight, typically below 500,000 atomic mass units. Fluids containing minimal amounts of these polymers will have high temperature low shear viscosities that are no greater than 0.25 cP than their high temperature high shear viscosities, when measured at 150° C. at shear rates of $2\times10^2$ sec.$^{-1}$ and $1\times10^6$ sec.$^{-1}$, respectively.

The ATF's of this invention provide exceptionally good low temperature fluidity for enhanced transmission operation at low ambient temperatures, strong hydrodynamic films for adequate wear protection, and excellent shear stability for improved transmission operation with increasing mileage. A description of components suitable to achieve the benefits of this invention follows.

Natural Lubricating Oils

Natural lubricating oils include animal oils, vegetable oils (e.g., castor oil and lard oil), petroleum oils, mineral oils, and oils derived from coal or shale. Typically, these oils will have kinematic viscosities of from 1 to 30, preferably from 2 to 20, more preferably from about 2 to 8, and most preferably from 3 to 5 mm$^2$/s (cSt) at 100° C.

The preferred natural lubricating oil is a mineral oil. This would include oils that are naphthenic or paraffinic in chemical structure. The oils may be refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may also be hydrotreated or hydrofined, dewaxed by chilling or catalytic processing, or hydrocracked. The mineral oil may be produced from natural crude sources or be composed of isomerized wax materials or residues of other refining processes.

Typically, the ATF will contain from about 2 to 80 weight percent of the mineral lubricating oil. The mineral oil may be added as a base oil by itself or included as a diluent with a component or additive added to the ATF. Preferred products contain from 10 to 75 weight percent mineral oil, and the most preferred products contain from about 10 to about 50 weight percent mineral oil.

Synthetic Lubricating Oils

The synthetic lubricating oils used in this invention are one of any number of commonly used synthetic hydrocarbon oils, which include, but are not limited to, poly-alpha-olefins, alkylated aromatics, and mixtures thereof. Examples of these oils are polymerized and interpolymerized olefins (e.g., polybutenes, polypropylenes, polypropylene-isobutylene copolymers, poly(1-hexenes), poly(1-octenes), poly(1-decenes)); alkylbenzenes (e.g., dodecylbenzenes, tetradecylbenzenes, dinonyl benzenes, di-(2-ethylhexyl) benzenes); polyphenyls (e.g., biphenyls, terphenyls, alkylated polyphenols); alkylated diphenyl ethers and derivatives, analogs and homologs thereof.

Particularly preferred synthetic lubricating oils are the poly-alpha-olefins, especially poly-alpha-olefins produced by oligomerizing 1-octene, 1-decene, 1-dodecene or mixtures thereof. The synthetic oils used in this invention will typically have kinematic viscosities of between 1 and 100, preferably between 2 and 100 $mm^2/s$ (cSt) at 100° C., with the most preferred oils having viscosities in the range of 2 to 6 $mm^2/s$ (cSt) at 100° C.

Typically, the fluids of this invention will contain from about 2 to 80 weight percent of the synthetic lubricating oils. Preferred fluids contain from 5 to 75 weight percent, and most preferred ranges are from about 20 to about 60 weight percent synthetic oil.

Seal Swell Agents

The seal swell agents useful with this invention are esters, alcohols, substituted sulfolanes, or mineral oils that cause swelling of elastomeric materials. The ester based seal swellers of this invention would include esters of monobasic and dibasic acids with monoalcohols, or esters of polyols with monobasic esters. Examples of ester type seal swelling agents are: diisooctyl adipate, dioctyl sebacate, di-isooctyl azelate, dioctyl phthalate, di-hexyl phthalate. Alcohol type seal swellers are linear alkyl alcohols of low volatility. Examples of suitable alcohols are decyl alcohol, tridecyl alcohol and tetradecyl alcohol. Examples of substituted sulfolanes are described in U.S. Pat. No. 4,029,588. Mineral oils useful as seal swellers are typically low viscosity mineral oils with high naphthenic or aromatic content. Examples of suitable mineral oils are Exxon Necton-37 (FN 1380) and Exxon Mineral Seal Oil (FN 3200). Typical fluids produced by this invention will contain from about 1 to about 30 weight percent seal sweller. Preferred ranges of seal sweller are from about 2 to about 20 weight percent and most preferred are from about 5 to about 15 weight percent.

Flow Improvers

The flow improvers of the current invention are oil-soluble polymers that modify the crystallization of any wax contained in the natural lubricating oil so that gelling of the oil is prevented, and viscosity increase at low temperature is minimized. These polymers act by modifying the size, number, and growth of wax crystals in lubricating oils in such a way as to impart improved low temperature handling, pumpability, and/or transmission operability. There are two common types of polymers used as flow improvers: one derives its activity from the backbone, the other from the sidechain.

The active backbone variety, such as ethylene-vinyl acetate (EVA) copolymers, has various lengths of methylene segments randomly distributed in the backbone of the polymer. These ethylenic segments which associate or co-crystallize with the wax crystals, inhibit further crystal growth due to branches and non-crystallizable segments in the polymer.

The active sidechain type polymers, which are the preferred materials for this invention, have methylene segments in the side chains, preferably normal alkyl groups. These polymers function similarly to the active backbone type except the side chains have been found to be more effective in treating isoparaffins as well as n-paraffins found in lubricating oils. Representative of this type of polymer are $C_8$ to $C_{18}$ dialkylfumarate vinyl acetate copolymers, polyacrylates, polymethacrylates, and esterified styrene-maleic anhydride copolymers.

While the polyacrylates, polymethacrylates, and styrene-maleic anhydrides may function as viscosity modifiers (i.e., polymeric compositions used to increase the viscosity index of lubricating compositions), it is appreciated by those skilled in the art that these compositions also function as flow improvers under certain circumstances. Such circumstances are a function of molecular weight and treat rate. Thus, as used in this invention, the term "flow improver" is intended to include polyacrylates, polymethacrylates, and styrene-maleic anhydrides having weight average molecular weights no greater than 500,000 atomic mass units as determined by, for example, gel permeation chromatography. The term "atomic mass unit" is a measure of atomic mass defined as equal to 1/12 the mass of a carbon atom of mass 12.

Typically, products of this invention will contain from 0.05 to about 2.0 weight percent flow improver. Preferred concentrations of flow improvers are from about 0.1 to about 2.0 weight percent and most preferred are from about 0.2 to about 2.0 weight percent.

Friction Modifiers

A wide variety of friction modifiers may be employed in the present invention including the following:

(i) Alkoxylated Amines

Alkoxylated amines are a particularly suitable type of friction modifier for use in this invention. These types of friction modifiers may be selected from the group consisting of (I), (II), and mixtures thereof, where (I) and (II) are:

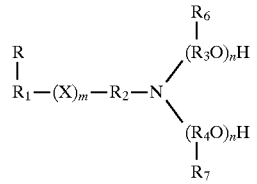

(I)

-continued and

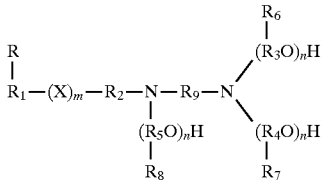

(II)

where:

R is H or $CH_3$;

$R_1$ is a $C_8$–$C_{28}$ saturated or unsaturated, substituted or unsubstituted, aliphatic hydrocarbyl radical, preferably $C_{10}$–$C_{20}$, most preferably $C_{14}$–$C_{18}$;

$R_2$ is a straight or branched chain $C_1$–$C_6$ alkylene radical, preferably $C_2$–$C_3$;

$R_3$, $R_4$, and $R_5$ are independently the same or different, straight or branched chain $C_2$–$C_5$ alkylene radical, preferably $C_2$–$C_4$;

$R_6$, $R_7$, and $R_8$ are independently H or $CH_3$;

$R_9$ is a straight or branched chain $C_1$–$C_5$ alkylene radical, preferably $C_2$–$C_3$;

X is oxygen or sulfur, preferably oxygen; m is 0 or 1, preferably 1; and n is an integer, independently 1–4, preferably 1.

In a particularly preferred embodiment, this type of friction modifier is characterized by formula (I) where X represents oxygen, R and $R_1$ contain a combined total of 18 carbon atoms, $R_2$ represents a $C_3$ alkylene radical, $R_3$ and $R^4$ represent $C_2$ alkylene radicals, $R_6$ and $R_7$ are hydrogens, m is 1, and each n is 1. Preferred amine compounds contain a combined total of from about 18 to about 30 carbon atoms.

Preparation of the amine compounds, when X is oxygen and m is 1, is, for example, by a multi-step process where an alkanol is first reacted, in the presence of a catalyst, with an unsaturated nitrile such as acrylonitrile to form an ether nitrile intermediate. The intermediate is then hydrogenated, preferably in the presence of a conventional hydrogenation catalyst, such as platinum black or Raney nickel, to form an ether amine. The ether amine is then reacted with an alkylene oxide, such as ethylene oxide, in the presence of an alkaline catalyst by a conventional method at a temperature in the range of about 90°–150° C.

Another method of preparing the amine compounds, when X is oxygen and m is 1, is to react a fatty acid with ammonia or an alkanol amine, such as ethanolamine, to form an intermediate which can be further oxyalkylated by reaction with an alkylene oxide, such as ethylene oxide or propylene oxide. A process of this type is discussed in, for example, U.S. Pat. No. 4,201,684.

When X is sulfur and m is 1, the amine friction modifying compounds can be formed, for example, by effecting a conventional free radical reaction between a long chain alpha-olefin with a hydroxyalkyl mercaptan, such as beta-hydroxyethyl mercaptan, to produce a long chain alkyl hydroxyalkyl sulfide. The long chain alkyl hydroxyalkyl sulfide is then mixed with thionyl chloride at a low temperature and then heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature near 100° C. to form the desired amine compounds. Processes of this type are known in the art and are discussed in, for example, U.S. Pat. No. 3,705,139.

In cases when X is oxygen and m is 1, the present amine friction modifiers are well known in the art and are described in, for example, U.S. Pat. Nos. 3,186,946, 4,170,560, 4,231,883, 4,409,000 and 3,711,406.

Examples of suitable amine compounds include, but are not limited to, the following:

N,N-bis(2-hydroxyethyl)-n-dodecylamine;
N,N-bis(2-hydroxyethyl)-1-methyl-tridecenylamine;
N,N-bis(2-hydroxyethyl)-hexadecylamine;
N,N-bis(2-hydroxyethyl)-octadecylamine;
N,N-bis(2-hydroxyethyl)-octadecenylamine;
N,N-bis(2-hydroxyethyl)-oleylamine;
N,N-bis(2-hydroxyethyl)-stearylamine;
N,N-bis(2-hydroxyethyl)-undecylamine;
N-(2-hydroxyethyl)-N-(hydroxyethoxyethyl)-n-dodecylamine;
N,N-bis(2-hydroxyethyl)-1-methyl-undecylamine;
N,N-bis(2-hydroxyethoxyethoxyethyl)-1-ethyl-octadecylamine;
N,N-bis(2-hydroxyethyl)-cocoamine;
N,N-bis(2-hydroxyethyl)-tallowamine;
N,N-bis(2-hydroxyethyl)-n-dodecyloxyethylamine;
N,N-bis(2-hydroxyethyl)-lauryloxyethylamine;
N,N-bis(2-hydroxyethyl)-stearyloxyethylamine;
N,N-bis(2-hydroxyethyl)-dodecylthioethylamine;
N,N-bis(2-hydroxyethyl)-dodecylthiopropylamine;
N,N-bis(2-hydroxyethyl)-hexadecyloxypropylamine;
N,N-bis(2-hydroxyethyl)-hexadecylthiopropylamine;
N-2-hydroxyethyl,N-[N',N'-bis(2-hydroxyethyl) ethylamine]-octadecylamine; and
N-2-hydroxyethyl,N-[N',N'-bis(2-hydroxyethyl) ethylamine]-stearylamine.

The most preferred additive is N,N-bis(2-hydroxyethyl)-hexadecyloxypropylamine. This additive is available from Tomah Company under the designation Tomah E-22-S-2.

The amine's hydrocarbyl chain length, the saturation of the hydrocarbyl chain, and the length and position of the polyoxyalkylene chains can be varied to suit specific requirements. For example, increasing the number of carbon atoms in the hydrocarbyl radical tends to increase the amine's melting temperature and oil solubility, however, if the hydrocarbyl radical is too long, the amine will crystallize from solution. Decreasing the degree of saturation in the hydrocarbyl radical, at the same carbon content of the hydrocarbyl chain, tends to reduce the melting point of the amine. Increasing the amount of alkylene oxide, to lengthen the polyoxyalkylene chains, tends to increase the amine's water solubility and decrease its oil solubility.

The amine compounds may be used as such. However, they may also be used in the form of an adduct or reaction product with a boron compound, such as a boric oxide, a boron halide, a metaborate, boric acid, or a mono-, di-, and trialkyl borate. Such adducts or derivatives may be illustrated, for example, by the following structural formula:

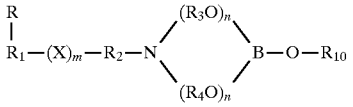

where R, $R_1$, $R_2$, $R_3$, $R_4$, X, m, and n are the same as previously defined and where $R_{10}$ is either hydrogen or an alkyl radical.

(ii) Carboxylic Acids/Anhydrides with Polyamines

A second type of friction modifier useful with this invention is the reaction product of a polyamine and a carboxylic acid or anhydride. Briefly, the polyamine reactant contains from 2 to 60 total carbon atoms and from 3 to 15 nitrogen atoms with at least one of the nitrogen atoms present in the form of a primary amine group and at least two of the remaining nitrogen atoms present in the form of primary or secondary amine groups. Non-limiting examples of suitable amine compounds include: polyethylene amines such as diethylene triamine (DETA); triethylene tetramine (TETA); tetraethylene pentamine (TEPA); polypropylene amines such as di-(1,2-propylene)triamine, di(1,3-propylene) triamine, and mixtures thereof. Additional suitable amines include polyoxyalkylene polyamines such as polyoxypropylene triamines and polyoxyethylene triamines. Preferred amines include DETA, TETA, TEPA, and mixtures thereof (PAM). The most preferred amines are TETA, TEPA, and PAM.

The carboxylic acid or anhydride reactant of the above reaction product is characterized by formula (III), (IV), (V), (VI), and mixtures thereof:

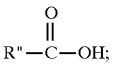

(III)

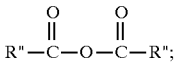

(IV)

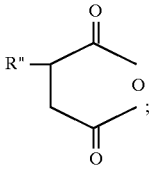

(V)

and

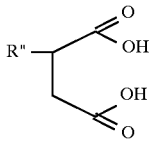

(VI)

where R" is a straight or branched chain, saturated or unsaturated, aliphatic hydrocarbyl radical containing from 9 to 29 carbon atoms, preferably from 11 to 23. When R" is a branched chain group, no more than 25% of the carbon atoms are in side chain or pendent groups. R" is preferably straight chained.

The R" hydrocarbyl group includes predominantly hydrocarbyl groups as well as purely hydrocarbyl groups. The description of these groups as predominantly hydrocarbyl means that they contain no non-hydrocarbyl substituents or non-carbon atoms that significantly affect the hydrocarbyl characteristics or properties of such groups relevant to their uses as described here. For example, a purely hydrocarbyl $C_{20}$ alkyl group and a $C_{20}$ alkyl group substituted with a methoxy substituent are substantially similar in their properties and would be considered hydrocarbyl within the context of this disclosure.

Non-limiting examples of substituents that do not significantly alter the hydrocarbyl characteristics or properties of the general nature of the hydrocarbyl groups of the carboxylic acid or anhydride are:

Ether groups (especially hydrocarbyloxy such as phenoxy, benzyloxy, methoxy, n-isotoxy, etc., particularly alkoxy groups of up to ten carbon atoms);

Oxo groups (e.g., —O— linkages in the main carbon chain

-continued

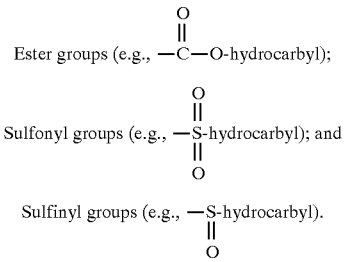

Ester groups (e.g., —C—O-hydrocarbyl);

Sulfonyl groups (e.g., —S-hydrocarbyl); and

Sulfinyl groups (e.g., —S-hydrocarbyl).

These types of friction modifiers can be formed by reacting, at a temperature from about 120° to 250° C., at least one polyamine and one carboxylic acid or anhydride in proportions of about 2 to 10 molar equivalents of carboxylic acid or anhydride per mole of amine reactant.

(iii) Other Friction Modifiers

Optionally, other friction modifiers may be used either alone or in combination with the foregoing described friction modifiers to achieve the desired fluid performance. Among these are esters of carboxylic acids and anhydrides with alkanols. Other conventional friction modifiers generally consist of a polar terminal group (carboxyl, hydroxyl, amino, etc.) covalently bonded to an oleophilic hydrocarbon chain.

Particularly preferred esters of carboxylic acids and anhydrides with alkanols are described in, for example, U.S. Pat. No. 4,702,850. This reference teaches the usefulness of these esters as friction modifiers, particularly the esters of succinic acids or anhydrides with thio-bis-alkanols, most particularly with esters of 2-octadecenyl succinic anhydride and thiodiglycol.

Examples of other conventional friction modifiers (i.e., polar terminal group+oleophilic hydrocarbon chain) are described by, for example, M. Belzer in the "Journal of Tribology" (1992), Vol. 114, pp. 675–682 and M. Belzer and S. Jahanmir in "Lubrication Science" (1988), Vol. 1, pp. 3–26.

Typically the friction modifiers will be present in finished ATF composition in an amount between 0.01 to 5, preferably 0.1 to 3, weight percent.

Other Additives

Other additives known in the art may be added to the ATF. These additives include dispersants, antiwear agents, antioxidants, corrosion inhibitors, detergents, extreme pressure additives, and the like. They are typically disclosed in, for example, "Lubricant Additives" by C. V. Smalheer and R. Kennedy Smith, 1967, pp. 1–11 and U.S. Pat. No. 4,105,571.

Representative amounts of these additives are summarized as follows:

| Additive | (Broad) Wt. % | (Preferred) Wt. % |
|---|---|---|
| Corrosion Inhibitor | 0.01–3 | 0.02–1 |
| Antioxidants | 0.01–5 | 0.2–3 |
| Dispersants | 0.10–10 | 2–5 |
| Antifoaming Agents | 0.001–1 | 0.001–0.5 |
| Detergents | 0.01–6 | 0.01–3 |
| Antiwear Agents | 0.001–5 | 0.2–3 |

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Mixtures of such dispersants can also be used.

The preferred dispersants are the alkenyl succinimides. These include acyclic hydrocarbyl substituted succinimides formed with various amines or amine derivatives such as are widely disclosed in the patent literature. Use of alkenyl succinimides which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable. Dispersants may be post-treated with many reagents known to those skilled in the art. (see, e.g., U.S. Pat. Nos. 3,254,025, 3,502,677, and 4,857,214).

Suitable antioxidants are amine-type and phenolic antioxidants. Examples of the amine-type antioxidants include phenyl alpha naphthylamine, phenyl beta naphthylamine, diphenylamine, bis-alkylated diphenyl amines (e.g., p,p'-bis (alkylphenyl)amines wherein the alkyl groups contain from 8 to 12 carbon atoms each). Phenolic antioxidants include sterically hindered phenols (e.g., 2,6-di-tert-butylphenol, 4-methyl-2,6-di-tert-butylphenol, etc.) and bis-phenols (e.g., 4,4'-methylenebis(2,6-di-tert-butylphenol), etc.) and the like.

The additive concentrates of this invention will contain the seal swelling agent, flow improver, friction modifier, and other desired additives in a natural and/or synthetic lubricating oil, in relative proportions such that by adding the concentrate to a larger amount of a suitable natural and/or synthetic oil the resulting fluid will contain each of the ingredients in the desired concentration. Thus, the concentrate may contain a synthetic oil as the lubricating oil if the desired final composition contains a lesser amount of synthetic oil relative to the mineral oil. The concentrate typically will contain between 25 to 100, preferably from 65 to 95, most preferably from 75 to 90 weight percent of the seal swelling agent, flow improver, friction modifier, other desired additives, and synthetic and/or natural oil.

The following examples are given as specific illustrations of the claimed invention. It should be understood, however, that the invention is not limited to the specific details set forth in the examples. All parts and percentages are by weight unless otherwise specified.

EXAMPLE 1

Table 1 shows sixteen (16) automatic transmission fluids that were produced by blending 8.0 mass percent of an additive package devoid of any flow improvers, into suitable ATF base fluids. The additive package contained conventional amounts of a succinimide dispersant, antioxidants, antiwear agents, friction modifiers, a corrosion inhibitor, an antifoamant, and a diluent oil. Additionally, each of the sixteen blends contained diisooctyl adipate as a seal swelling agent.

The viscosities of the various lubricating oils used in Tables 1 and 2 are summarized below.

| Oil | Viscosity ($mm^2/s$) at 100° C. |
|---|---|
| PAO-4 | ≈4.0 |
| Exxon S100N | ≈4.0 |
| Exxon FN 3147 | ≈2.2 |
| Exxon Necton 37 | ≈3.0 |
| Imperial MXT-5 | ≈3.8 |
| Chevron RLOP | ≈4.1 |
| Petro-Canada 80 Neutral | ≈3.4 |
| Petro-Canada 160 Neutral | ≈5.6 |

The flow improvers used are identified in Tables 1 and 2 by their tradenames. The PARAFLOW® products are fumarate-vinyl acetate copolymers with varying sidechain lengths. The TLA (Texaco) and VISCOPLEX® products are polymethacrylates of varying molecular weights and sidechain lengths.

Varying amounts of several different flow improvers were added to BLENDS 3–9 and 11–16. The exact compositions of the blends formed are shown in Table 1. Each blend was then characterized by measuring its kinematic viscosity at 100° C. (using ASTM D445), its Brookfield viscosity at −40° C. (using ASTM D2983), its High Temperature Low Shear (HTLS) viscosity at 150° C. and $2\times10^2$ $sec.^{-1}$. (using ASTM D4683), and its High Temperature High Shear (HTHS) viscosity at 150° C. and $1\times10^6$ $sec.^{-1}$ (also using ASTM D4683). The results of the viscosity measurements are also given in Table 1. The last line in Table 1 shows the difference between the HTLS and HTHS viscosity measurements. The smaller the difference between these measurements is indicative of a more shear stable fluid.

All of the ATF's produced in Table 1 meet one requirement of this invention, i.e., having a kinematic viscosity of at least 4.0 $mm^2/s$ (cSt) at 100° C. The fluids designated 1B, 2B, and 10B are 'blanks' (i.e., they contain no added polymers), and are included as comparisons for showing: (1) the actual kinematic viscosities of the base blends prior to addition of polymeric material, (2) the difference between the HTLS and HTHS viscosity measurements is essentially zero in the absence of polymeric additives, and (3) the desired low temperature Brookfield viscosity of this invention cannot be met in the absence of a flow improver.

Comparing BLEND 2B with BLENDS 4, 5, and 6 shows the effect of adding flow improver (in this case a polymethacrylate). As the treat rate of flow improver increases, the kinematic viscosity at 100° C. of the fluid quickly rises from 4.22 to 7.69 $mm^2/s$ (cSt). This indicates that the flow improver increasingly functions as a viscosity modifier (i.e., viscosity index improver) as the treat rate increases. The difference between the HTLS and HTHS viscosities also rises from 0.02 (essentially 0) to 0.6 cP, which indicates that BLEND 6, which contains 5.0 percent of the polymethacrylate, would have very poor shear stability in vehicles and not meet the criteria for this invention. These examples demonstrate the necessity of minimizing or eliminating the use of polymers which function as polymeric thickeners, especially when the molecular weight of the polymers approaches 500,000 atomic mass units.

BLENDS 7 to 9 and 11 to 12 concern the effect of polymethacrylate type and molecular weight, as well as the effect of base stock. This data show that in all cases the viscosity and shear stability requirements for this invention can be met when using 2.0 weight percent or less flow improver.

BLENDS 13 through 16 show that in no case can the HTLS-HTHS criteria of this invention (≦0.25 cP) be met with a mineral oil blend not containing synthetic lubricating oil, even when using highly naphthenic oils with very good low temperature properties.

Two commercial non-synthetic DEXRON®-III ATF's are shown as BLENDS 17C and 18C in Table 1 for comparison. It can be seen that they do not meet the viscometric criteria of this invention—they fail the HTLS-HTHS (shear-stability requirement) difference of no greater than 0.25 cP.

EXAMPLE 2

Fifteen (15) ATF's (BLENDS 19 to 33) fully meeting the criteria of the invention were produced using varying amounts of seal sweller, natural and synthetic lubricating oils, and varying types and amounts of polymeric flow improvers. Relevant viscosity and shear measurements were made on each fluid and the results are shown in Table 2.

The data show that ATF's with kinematic viscosities of at least 4.0 $mm^2/s$ (cSt) at 100° C. and Brookfield viscosities at −40° C. of no greater than 18,000 cP (indeed, no greater than 10,000 cP) can be produced by this invention. These data also show that ATF's with Brookfield viscosities of less than 5,000 cP are also possible (e.g., BLENDS 22, 24, 26, 27, 28, 29, 30, 31, and 32). All of these fluids have a minimum HTHS viscosity of 1.5 cP and the difference between HTLS and HTHS is no greater than 0.25 cP.

The principles, preferred embodiments, and modes of operating of this invention have been described in the foregoing specification. However, the invention which is intended to be protected herein is not to be construed as limited to the particular forms disclosed, since these are to be regarded as illustrative rather than restrictive. Variations and changes may be made by those skilled in the art without departing from the spirit of the invention.

TABLE 1

ATF BLENDS

| BLENDS: | 1B | 2B | 3 | 4 | 5 | 6 | 7 | 8 | 9 | 10B |
|---|---|---|---|---|---|---|---|---|---|---|
| COMPONENT (MW) | | | | | | | | | | |
| ADDITIVE | 8.00 | 8.00 | 8.00 | 8.00 | 8.00 | 8.00 | 8.00 | 8.00 | 8.00 | 8.00 |
| PAO-4 | 78.00 | 50.00 | 50.00 | 50.00 | 50.00 | 50.00 | 50.00 | 50.00 | 50.00 | 40.00 |
| DI-ISOOCTYL ADIPATE | 14.00 | 12.00 | 12.00 | 11.00 | 10.00 | 7.00 | 10.00 | 10.00 | 10.00 | 12.00 |
| EXXON S100N | — | 30.00 | 29.75 | 30.00 | 30.00 | 30.00 | 30.00 | 30.00 | 30.00 | — |
| EXXON FN 3147 | — | — | — | — | — | — | — | — | — | — |
| EXXON NECTON 37 | — | — | — | — | — | — | — | — | — | — |
| IMPERIAL MXT 5 | — | — | — | — | — | — | — | — | — | 40.00 |
| PAPAFLOW* 385 | — | — | 0.25 | — | — | — | — | — | — | — |
| VISCOPLEX** 5011B (420,000) | — | — | — | 1.00 | 2.00 | 5.00 | — | — | — | — |
| VISCOPLEX 5011H (375,000) | — | — | — | — | — | — | 2.00 | — | — | — |
| VISCOPLEX 5089 (150,000) | — | — | — | — | — | — | — | 2.00 | — | — |
| VISCOPLEX 8-220 (75,000) | — | — | — | — | — | — | — | — | 2.00 | — |
| VISCOSITIES | | | | | | | | | | |
| KV 100, $mm^2/s$ (CSt) | 4.12 | 4.22 | 4.26 | 4.82 | 5.42 | 7.69 | 5.67 | 5.05 | 4.79 | 4.14 |
| BROOKFIELD @ −40 C, cP | 2,460 | >45,000 | 4,150 | 4,160 | 4.240 | 6,360 | 4,650 | 4,660 | 4,580 | >75,000 |
| HTLS @ 150 C, cP | 1.57 | 1.60 | 1.57 | 1.85 | 2.08 | 2.79 | 2.12 | 1.91 | 1.78 | 1.62 |
| HTHS @ 150 C, cP | 1.56 | 1.58 | 1.59 | 1.71 | 1.83 | 2.19 | 1.93 | 1.85 | 1.81 | 1.61 |
| HTLS-HTHS, cP | 0.01 | 0.02 | −0.02 | 0.14 | 0.25 | 0.60 | 0.19 | 0.06 | −0.03 | 0.01 |

| BLENDS: | 11 | 12 | 13 | 14 | 15 | 16 | 17C | 18C |
|---|---|---|---|---|---|---|---|---|
| COMPONENT (MW) | | | | | | | | |
| ADDITIVE | 8.00 | 8.00 | 8.00 | 8.00 | 8.00 | 8.00 | COMMER- | COMMER- |
| PAO-4 | 40.00 | 40.00 | — | — | — | — | CIAL | CIAL |
| DI-ISOOCTYL ADIPATE | 12.00 | 10.00 | — | — | — | — | ATF 1 | ATF 2 |
| EXXON S100N | — | — | — | — | — | — | | |
| EXXON FN 3147 | — | — | — | — | 89.00 | 86.00 | | |
| EXXON NECTON 37 | — | — | 90.00 | 87.00 | — | — | | |
| IMPERIAL MXT 5 | 39.75 | 40.00 | — | — | — | — | | |
| PAPAFLOW* 385 | 0.25 | — | — | — | — | — | | |
| VISCOPLEX** 5011B (420,000) | — | — | 2.00 | 5.00 | 3.00 | 6.00 | | |
| VISCOPLEX 5011H (375,000) | — | — | — | — | — | — | | |
| VISCOPLEX 5089 (150,000) | — | — | — | — | — | — | | |
| VISCOPLEX 8-220 (75,000) | — | 2.00 | — | — | — | — | | |
| VISCOSITIES | | | | | | | | |
| KV 100, $mm^2/s$ (CSt) | 4.21 | 5.33 | 4.85 | 7.15 | 4.23 | 6.20 | 7.06 | 7.88 |
| BROOKFIELD @ −40 C, cP | 3,960 | 4,280 | 13,260 | 18,740 | 4,660 | 6,640 | 17,000 | 16,000 |
| HTLS @ 150 C, cP | 1.57 | 2.01 | 1.91 | 2.72 | 1.73 | 2.49 | 2.65 | 2.95 |
| HTHS @ 150 C, cP | 1.53 | 1.81 | 1.60 | 1.97 | 1.44 | 1.73 | 2.08 | 2.10 |
| HTLS-HTHS, cP | 0.04 | 0.20 | 0.31 | 0.75 | 0.29 | 0.76 | 0.57 | 0.85 |

*PARAFLOW is a registered trademark of Exxon Chemical Co.
**VISCOPLEX is a registered trademark of Rohm Darmstadt, Ag.

TABLE 2

| | SAMPLE FORMULATIONS | | | | | | | | | | | | | | |
|---|---|---|---|---|---|---|---|---|---|---|---|---|---|---|---|
| BLENDS: | 19 | 20 | 21 | 22 | 23 | 24 | 25 | 26 | 27 | 28 | 29 | 30 | 31 | 32 | 33 |
| COMPONENT | | | | | | | | | | | | | | | |
| Additive | 8.00 | 8.00 | 8.00 | 8.00 | 8.00 | 8.00 | 8.00 | 8.00 | 8.00 | 8.00 | 8.00 | 8.00 | 8.00 | 8.00 | 8.00 |
| Di-isooctyl Adipate | 10.00 | 10.00 | 10.00 | 10.00 | 10.00 | 10.00 | 10.00 | 10.00 | 10.00 | 10.00 | 10.00 | 10.00 | 10.00 | 7.00 | 12.00 |
| PAO-4 | 41.00 | 56.70 | 41.38 | 57.22 | 41.00 | 56.70 | 41.00 | 32.40 | 49.05 | 48.60 | 40.88 | 40.50 | 36.40 | 38.50 | 30.00 |
| PARAFLOW 385* | 1.00 | 1.00 | 0.25 | 0.25 | — | — | — | — | 0.25 | — | 0.25 | — | 0.20 | — | 0.03 |
| PARAFLOW 392 | — | — | — | — | 1.00 | — | — | — | — | — | — | — | — | — | |
| TLA 5012** | — | — | — | — | | 1.00 | 1.00 | 1.00 | — | 1.00 | — | 1.00 | — | 1.00 | — |
| EXXON Solvent 100 Neutral | 40.00 | 24.30 | 40.37 | 24.53 | 40.00 | 24.30 | — | — | — | — | — | — | — | — | — |
| EXXON Solvent 75 Neutral | — | — | — | — | — | — | — | 48.60 | — | — | — | — | — | — | — |
| CHEVRON RLOP 100 Neutral | — | — | — | — | — | — | — | — | 32.70 | 32.40 | — | — | — | — | — |
| IMPERIAL MXT-5 | — | — | — | — | — | — | — | — | — | — | 40.87 | 40.50 | — | — | — |
| PETRO-CANADA 80 Neutral | — | — | — | — | — | — | — | — | — | — | — | — | 45.40 | 45.50 | 29.75 |
| PETRO-CANADA 160 Neutral | — | — | — | — | — | — | — | — | — | — | — | — | — | — | 20.00 |
| VISCOSITY | | | | | | | | | | | | | | | |
| Kinematic @ 100 C., cSt | 4.45 | 4,44 | 4.34 | 4.30 | 4.51 | 4.89 | 4.93 | 4.40 | 4.29 | 4.89 | 4.28 | 4.88 | 4.08 | 4.63 | 4.30 |
| Brookfield @ −40 C., cP | 7,680 | 6,800 | 5,120 | 3,820 | 8,060 | 3,580 | 5,340 | 3,700 | 4,080 | 4,300 | 4,140 | 4,460 | 4,560 | 4,240 | 5,960 |
| HTLS @ 150 C., cP | 1.63 | 1.61 | 1.60 | 1.60 | 1.70 | 1.79 | 1.84 | 1.68 | 1.60 | 1.79 | 1.60 | 1.77 | 1.48 | 1.72 | 1.58 |
| HTHS @ 160 C., cP | 1.62 | 1.60 | 1.61 | 1.60 | 1.67 | 1.72 | 1.76 | 1.61 | 1.61 | 1.71 | 1.59 | 1.72 | 1.52 | 1.67 | 1.59 |
| HTLS-HTHS | 0.01 | 0.01 | −0.01 | 0.00 | 0.03 | 0.07 | 0.08 | 0.07 | −0.01 | 0.08 | 0.01 | 0.05 | −0.04 | 0.05 | −0.01 |

*PARAFLOW is a registered trademark of EXXON Chemical Co.
**TLA is a designation of Texaco Chemical Co.

We claim:

1. An automatic transmission fluid composition comprising:

(a) from about 2 to 80 weight percent of a natural lubricating oil having a kinematic viscosity from 1 to 30 $mm^2/s$ at 100° C.;

(b) from about 2 to 80 weight percent of a synthetic lubricating oil having a kinematic viscosity from 1 to 100 $mm^2/s$ at 100° C.;

(c) from 1 to 30 weight percent of a seal swelling agent;

(d) from 0.05 to 2.0 weight percent of a flow improver, wherein the flow improver is selected from the group consisting of $C_8$ to $C_{18}$ dialkylfumarate vinyl acetate copolymers, styrene-maleic anhydride copolymers, polymethacrylates, polyacrylates, and their mixtures, providing the styrene-maleic anhydride copolymers, polymethacrylates and polyacrylates each have a weight average molecular weight no greater than 500, 000 atomic mass units; and (e) from 0.01 to 5.0 weight percent of a friction modifier;

providing that the resulting fluid composition has a kinematic viscosity of at least 4.0 $mm^2/s$ at 100° C., a −40° C. Brookfield viscosity no greater than about 18,000 centipoise, a high temperature high shear viscosity at least 1.5 centipoise at a shear rate of $1\times10^6$ $sec.^{-1}$ and temperature of 150° C., and no greater than a 0.25 centipoise difference between a high temperature low shear viscosity measured at a shear rate of $2\times10^2$ $sec.^{-1}$ and temperature of 150° C. and said high temperature high shear viscosity.

2. The composition of claim 1 where the synthetic lubricating oil is a poly-alpha-olefin-, monoester-, diester-, polyolester-based oil, or mixture thereof.

3. The composition of claim 2 where the synthetic lubricating oil is a poly-alpha-olefin.

4. The composition of claim 3 where the friction modifier is selected from the group consisting of (I); (II); reaction products of polyamines with (III), (IV), (V), (VI); and mixtures thereof, where (I), (II), (III), (IV), (V), (VI) are:

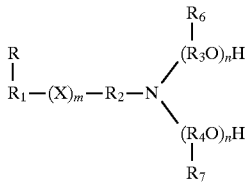
(I)

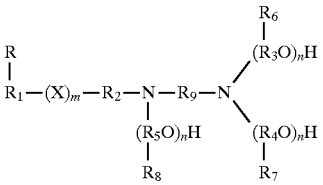
(II)

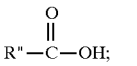
(III)

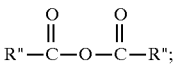
(IV)

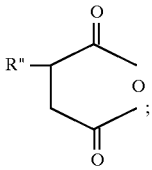
(V)

and

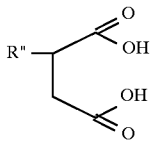
(VI)

where:

R is H or $CH_3$;

$R_1$ is a $C_8$–$C_{28}$ saturated or unsaturated, substituted or unsubstituted, aliphatic hydrocarbyl radical;

$R_2$ is a straight or branched chain $C_1$–$C_6$ alkylene radical;

$R_3$, $R_4$, and $R_5$ are independently the same or different, straight or branched chain $C_2$–$C_5$ alkylene radical;

$R_6$, $R_7$, and $R_8$ are independently H or $CH_3$;

$R_9$ is a straight or branched chain $C_1$–$C_5$ alkylene radical;

X is oxygen or sulfur;

m is 0 or 1;

n is an integer, independently 1–4; and

R" is a straight or branched chain, saturated or unsaturated, aliphatic hydrocarbyl radical containing from 9 to 29 carbon atoms with the proviso that when R" is a branched chain group, no more than 25% of the carbon atoms are in side chain or pendent groups.

5. The composition of claim 4 where the friction modifier is an ethoxylated amine, alkyl amide, or mixture thereof.

6. The composition of claim 5 where the composition further comprises a borated or non-borated succinimide dispersant, a phenolic or amine antioxidant, such that the sum of the dispersant, antioxidant, and friction modifier is between 2.0 to 11 weight percent of the composition.

7. The composition of claim 1 wherein the −40° C. Brookfield viscosity is no greater than about 10,000 cP.

8. A method for producing the composition of claim 1 comprising the steps of:

(a) providing a major amount of the natural and synthetic lubricating oil; and (b) adding to the lubricating oil the flow improver, seal swelling agent, and 0.01 to 5.0 weight percent of the friction modifier.

9. An automatic transmission fluid composition comprising:

(a) from about 2 to 80 weight percent of a natural lubricating oil having a kinematic viscosity from 2 to 8 $mm^2/s$ at 100° C.;

(b) from about 2 to 80 weight percent of a synthetic lubricating oil having a kinematic viscosity from 2 to 100 $mm^2/s$ at 100° C.;

(c) from 1 to 30 weight percent of a seal swelling agent;

(d) from 0.05 to 2.0 weight percent of a flow improver, wherein the flow improver is selected from the group consisting of $C_8$ to $C_{18}$ dialkylfumarate vinyl acetate copolymers, styrene-maleic anhydride copolymers, polymethacrylates, polyacrylates, and their mixtures, providing the styrene-maleic anhydride copolymers, polymethacrylates and polyacrylates each have a weight average molecular weight no greater than 500,000 atomic mass units; and (e) from 0.01 to 5.0 weight percent of a friction modifier;

providing that the resulting fluid composition has a kinematic viscosity of at least 4.0 $mm^2/s$ at 100° C., a −40° C. Brookfield viscosity no greater than about 18,000 centipoise, a high temperature high shear viscosity of at least 1.5 centipoise at a shear rate of $1\times10^6$ $sec.^{-1}$ and a temperature of 150° C., and no greater than a 0.25 centipoise difference between a high temperature low shear viscosity measured at a shear rate of $2\times10^2$ $sec.^{-1}$ and a temperature of 150° C. and said high temperature high shear viscosity.

10. The composition of claim 9 wherein the flow improver is a polymethacrylate.

11. The composition of claim 9 wherein the flow improver is a styrene-maleic anhydride copolymer.

12. The composition of claims 10 or 11 wherein the −40° C. Brookfield viscosity is no greater than about 15,000 cP.

* * * * *